US005086591A

United States Patent [19]

Panetti

[11] Patent Number: 5,086,591

[45] Date of Patent: Feb. 11, 1992

[54] REPROFILING METHOD OF THE RAILS OF A RAILROAD TRACK AND RAILROAD VEHICLE FOR PERFORMING THE SAME

[75] Inventor: Romolo Panetti, Geneva, Switzerland

[73] Assignee: Speno International S. A., Geneva, Switzerland

[21] Appl. No.: 560,584

[22] Filed: Jul. 30, 1990

[30] Foreign Application Priority Data

Aug. 28, 1989 [CH] Switzerland ..... 3116/89

[51] Int. Cl.[5] ..... B24B 49/00

[52] U.S. Cl. ..... 51/165.71; 51/165.75; 51/178; 51/326

[58] Field of Search ..... 51/178, 165 R, 165.71, 51/165.72, 281 R, 326, 165.74, 165.75, 165.76; 364/474.06, 474.05, 474.15

[56] References Cited

U.S. PATENT DOCUMENTS 4,091,578 5/1978 Panetti .
4,115,857 9/1978 Panetti .
4,135,332 1/1979 Theurer ..... 51/178
4,417,466 11/1983 Panetti .
4,531,837 7/1985 Panetti .
4,541,182 9/1985 Panetti .
4,785,589 11/1988 Buhler ..... 51/281 R
4,905,422 3/1990 Panetti .
4,920,701 5/1990 Panetti .

*Primary Examiner*—M. Rachuba
*Attorney, Agent, or Firm*—Young & Thompson

[57] ABSTRACT

A method for reprofiling the rails of a railway track and a machine for doing so. The reprofiling machine comprises measuring apparatus 16 of the transversal profile of the rail 11 for each line of rails. It comprises a storing 23 of at least one base reference profile for each type of rails and of at least one other reference profile for each base reference; and a selector 25, 26 of a pair of reference profiles as well as a device assignating one of the reference profiles of that pair to one of the line of rails and the other profile to the other line of rails. It comprises a comparator 23 of the measured profile of each rail to the selected reference profile; a controller and/or a selector in function of these comparison datas of a configuration, position and power, of reprofiling tools assigned to each line of rails.

13 Claims, 8 Drawing Sheets

| X | $Y_b$ | $Y_1$ | $\Delta Y_1$ | $Y_{1a}$ | $\Delta Y_{1a}$ |
|---|---|---|---|---|---|
| $X_1$ | $Y_{b1}$ | $Y_{11}$ | +1 | $Y_{1a1}$ | +1,2 |
| $X_2$ | $Y_{b2}$ | $Y_{12}$ | +2 | $Y_{1a2}$ | +2,3 |
| $X_3$ | $Y_{b3}$ | $Y_{13}$ | +1,5 | $Y_{1a3}$ | +1,7 |
| ⋮ | | | | | |
| $X_8$ | $Y_{b8}$ | $Y_{18}$ | 0 | $Y_{1a8}$ | 0 |
| $X_9$ | $Y_{b9}$ | $Y_{19}$ | 0 | $Y_{1a9}$ | 0 |

FIG. 8
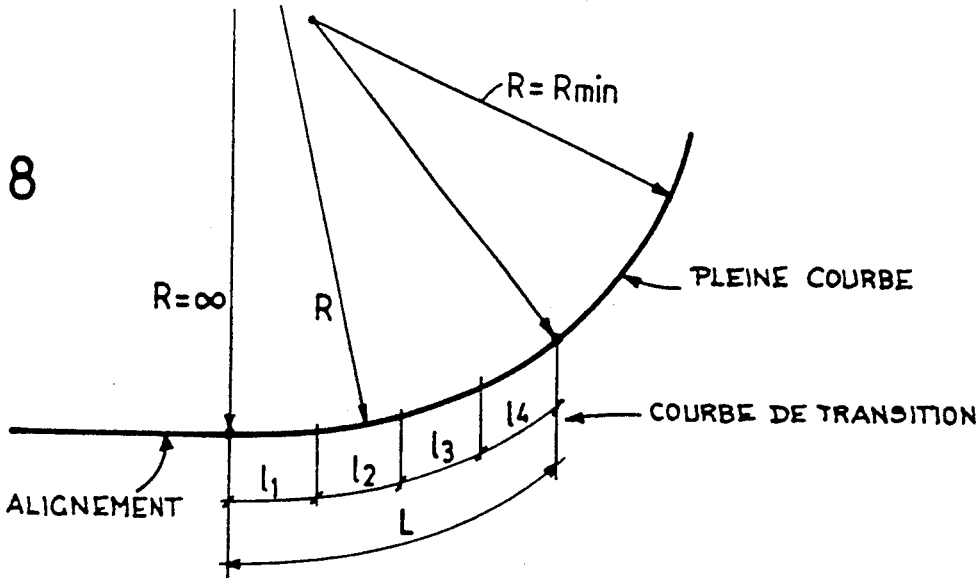
FIG. 9
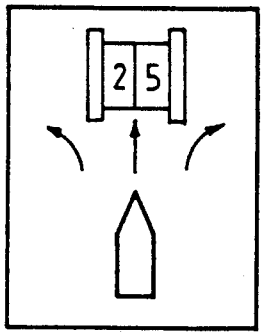
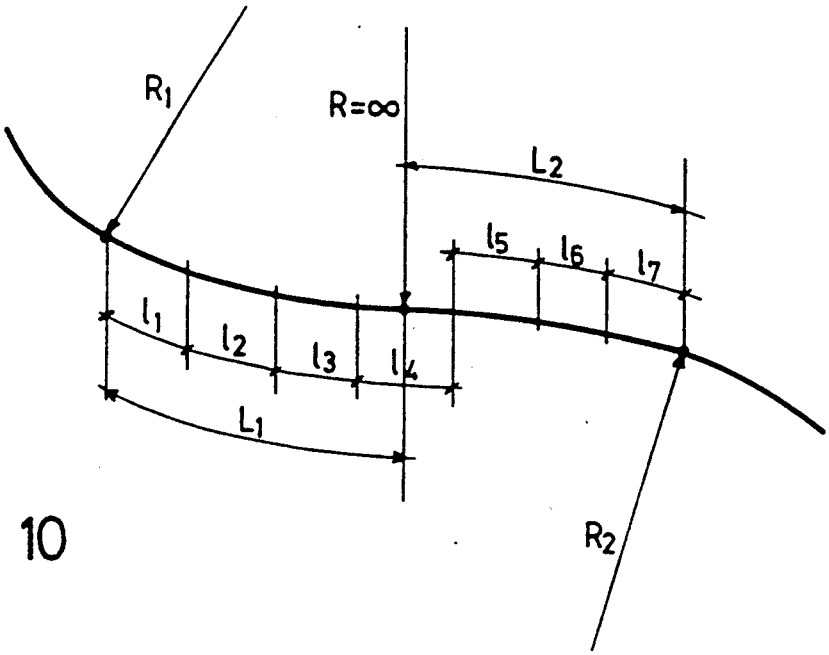
FIG. 10

REPROFILING METHOD OF THE RAILS OF A RAILROAD TRACK AND RAILROAD VEHICLE FOR PERFORMING THE SAME

The state and/or the load of the railroad trains increasing constantly, it becomes necessary to reprofile the rails of the railroad tracks, with always more precision, even to reprofile these rails after their setting in place and before the trains roll thereon.

The existing reprofiling machines or vehicles are well adapted to the automatic reprofiling of worn rails or deformed rails for the elimination of the undulations of great (0,3 to 3 m) or small (3 cm to 30 cm) wavelength or to give to the rails of the track a transversal profile near its original profile or another desired profile, such as a medium wearing off profile. As the theoric profile of the rail is symetrical, these machines have been designed for symetric reprofiling such as they are used in the alignments and in the curves having a great radius of curvature. However they do not permit to take account of the particular problems due to the rolling of trains on track portions having average or short radius of curvature others than those relative to the elimination of the undulatory deformations and of the burrs of the rails.

But it appears that for the modern trains these problems, which are not taken in account by the normal reprofiling, become burdening since they give raise to heavy wearing off of the internal sides of the rails as well as of the wheels flanges and have to be given a solution.

One knows that each shaft of a train vehicle carries at each of its ends a wheel rigidly mounted on it. The profile of the wheel periphery is slightly conical, inclined selves are not mounted perpendicularly to the cross-members, but their axis of symmetry is inclined of an angle generally equal to 1/20 towards the inside of the track.

This particular disposition enables, particularly on the rectilinear portions of the track or in a curve with a great radius of curvature to realize, due to the dicone formed by the wheels and the inclination of the rails, an autocentering effect on the shaft ensuring the stability of the rolling trains.

In fact as can be seen on FIG. 1 if the shaft extending parallely to the straight e displaces for example towards the right, the radius rb above the rail B increases whereas a radius ra above the rail A diminishes. In fact the rolling surfaces of the periphery of the wheels a, b form an angle with the axis of the shaft e and extend parallely to the directions S,S' in contact with the rails A,B. The rolling circumferences of the wheels being not equal, the shaft will have the tendency to advance more on the rail B than on the rail A causing therefore its automatic recentering.

This phenomenum of recentering is performed to satisfaction when the track is rectilinear or submitted only to curves of great radius of curvature. It is different in the portions of the track having a medium or short radius of curvature even for new undeformed rails which are not worn due to the passage of the trains, since the difference in the radius of the wheels at their contact point with the rails is not sufficient to compensate the difference of length between the arc of circle of the outside rail and the one of the inside rails. The shaft has then the tendency to displace towards the outside of the curve, the outer wheel tries to ride on the rail causing a very heavy wearing off through friction of the flange of the wheel against the inside face of the head of the rail deforming the wheel and the rail, and can be very dangerous for the security of the rolling of the train.

To remedy to this drawback several solutions have been proposed, particularly the realization of special bogies. These solutions are very complex and costly and do not resolve the problem for all the vehicles which are equipped with conventional shafts and bogies.

The only solution existing nowadays to resolve this problem consists to profile or reprofile the rails of a railroad track so as to give them an asymetric transversal profile. By doing so the outside wheel rolls on a diameter which is greater and the inside wheel on a diameter which is smaller so that the difference in the periphery of the rolling circles of the wheels will correspond approximatively to the difference of length of the arcs of circle of the outside rail and of the inside rail for one shaft revolution.

In order to do so, it is necessary to cut out the outside of the outside rail and the inside of the inside rail. The outside wheel is then in contact with its rail on a greater diameter and the inside wheel on a smaller diameter as shown on FIG. 2 where it is to be seen that the radius ra is smaller than the radius rb.

When the curve is not too tight that is for curves having an average radius of curvature, the modification of the transversal profile of one of the rails only is sufficient to obtain the desired effect. For example, the inside rail will keep its normal transversal profile as on the rectilinear portions of the track, and the outside rail only will present a modified profile, that will be cut off at its outside.

These special profiling or reprofiling operations in an asymetric way of the rails of a track in average or tight curve are very long and complex to realize since it can not be executed with the automatic reprofiling machines existing which all work with only one reference profile to execute the reprofiling operations. Reference be made here for example to the automatic reprofiling machines of the type described for example in the patents CH 592.780; CH 606.616; CH 654.047.

Now to profile or reprofile these portions of curved tracks it is necessary to control case by case manually the tools of the existing reprofiling machines with all the inconvenients that this comprises, imprecision, long time for its execution and thus a long immobilisation of the track, an always approximative work only which is based on empirical datas and left to the sole judgement of the workmen.

Doing so it is frequent that the cutting off is too important which is very bad for the rail since it diminishes its life time and its resistance.

The present invention has for aim to render possible the initial profiling as well as the reprofiling of the rails of a railroad track in a controlled asymetric manner in the curves so as to obviate to the precited drawbacks.

The present invention has for its object an automatic method of profiling and of reprofiling in site the rails of a railroad track either symetrically or asymetrically which can be used as well in the straight portion as in the curve or counter-curve.

The invention relates to a profiling or reprofiling method of the rails of a railroad track according to which one measures for each line of rails at least its transversal real profile and which is characterized by the fact that one establishes for at least one type of rails one transversal base reference profile and at least another transversal reference profile; that one selects one pair of reference profiles; that one attributes to each of the lines of rails one of the reference profiles of the pair selected; that one compares the real transversal profile of each line of rails with the reference transversal profile which is assigned to it, these comparison datas permitting the selection of a particular tool configuration for each line of rails.

The invention concerns also a machine for the reprofiling of rails of a railroad track to perform the said method, which comprises measuring means of the transversal profile of the rail for each line of rails, storing means of at least one base reference profile for each type of rails and of at least one other reference profile for each base reference profile; selecting means of a pair of reference profiles as well as means for assigning one of these reference profiles of the pair to one of the line of rails and the other profile to the other line of rails; and comparison means of the measured profile of each rail to the selected reference profile; means for controlling and/or selecting in function of these comparison datas a configuration, position and power, of reprofiling tools assigned to each of the line of rails.

The attached drawing shows schematically and by way of example certain particularities of the method and of the profiling and reprofiling machine of the rails of a railroad track according to the invention.

Figures 7, 7A:
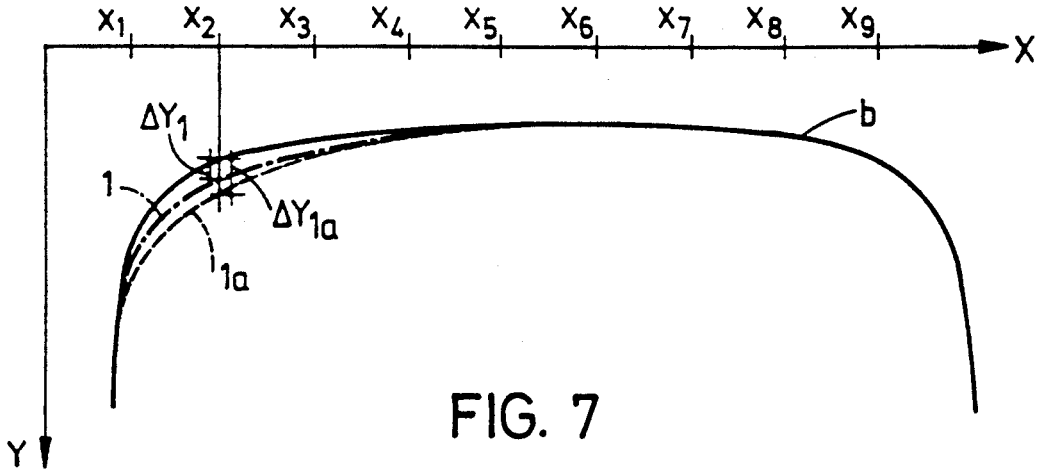

FIG. 7, 7*a* show the manner to memorize the reference base profiles as well as the corresponding asymetric reference profiles.

FIGS. 8 to 10 show a practical reprofiling example of rails in a transition curve.

Figure 11:
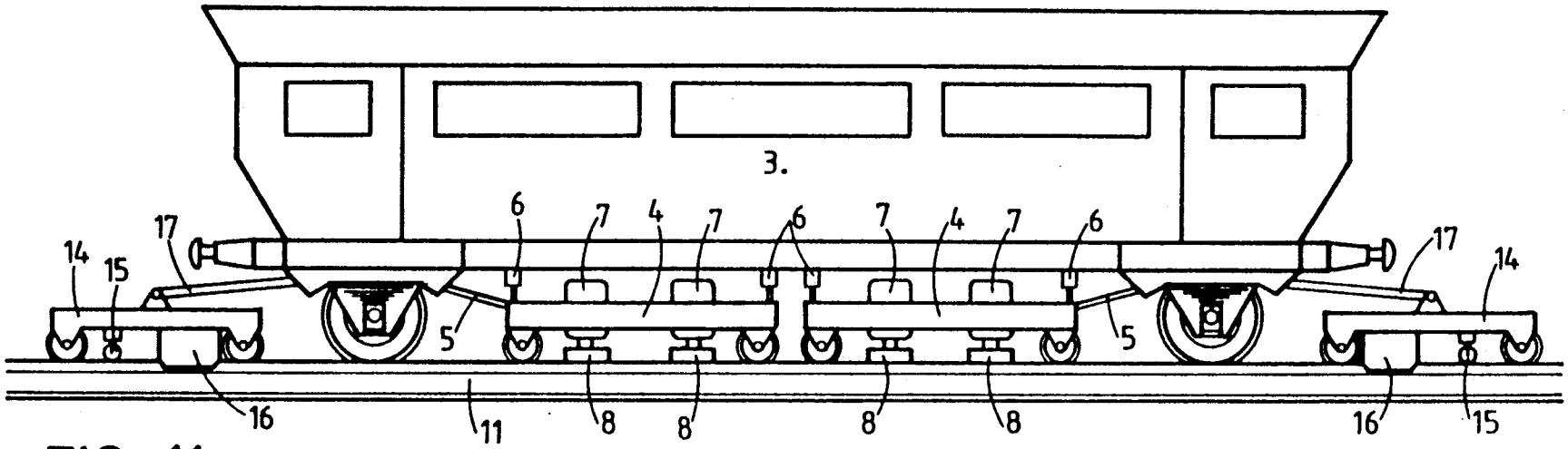

FIG. 11 is a general view of a machine for the reprofiling of the rails according to the invention.

Figure 12:
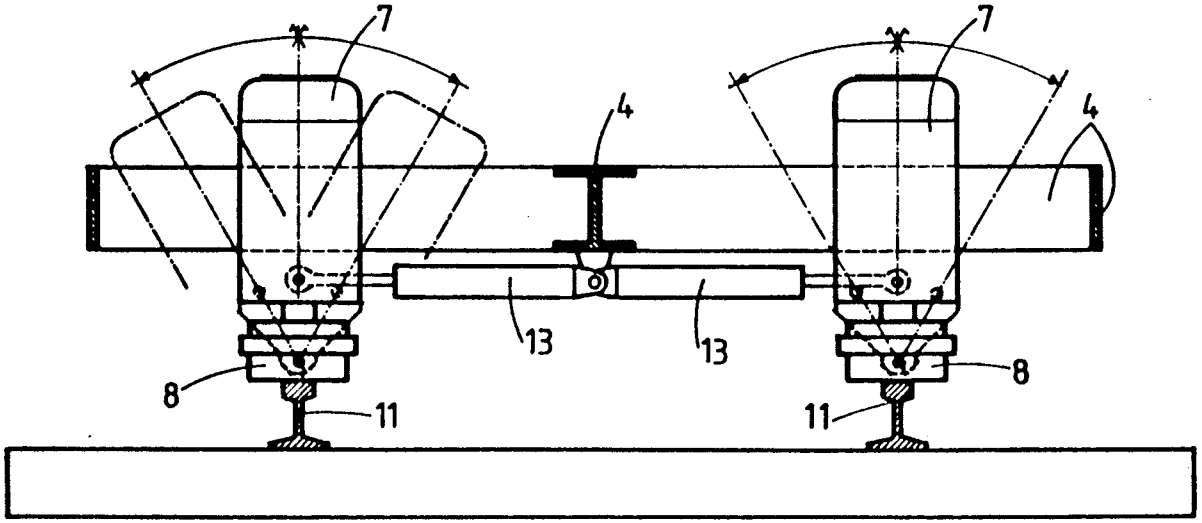
Figure 13:
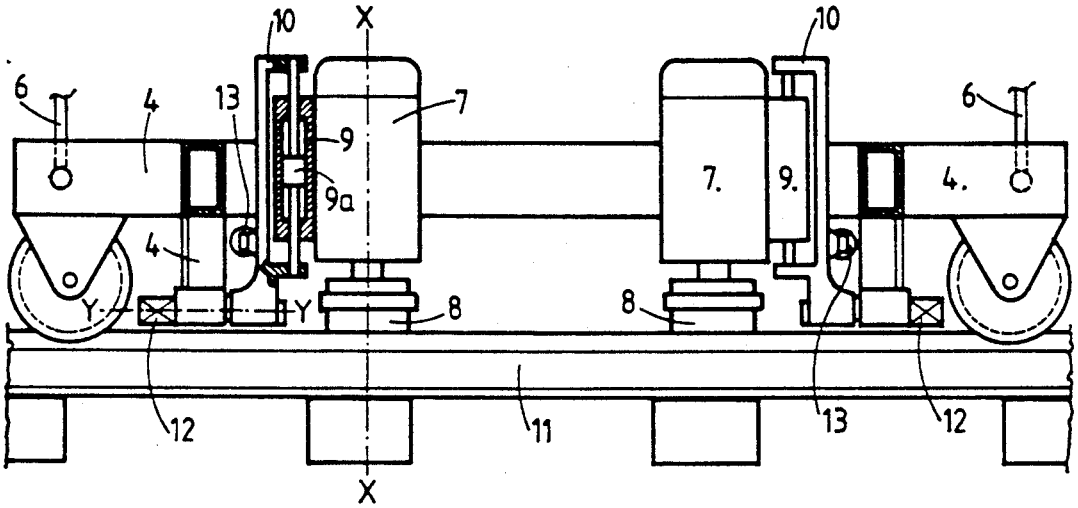
Figure 14:
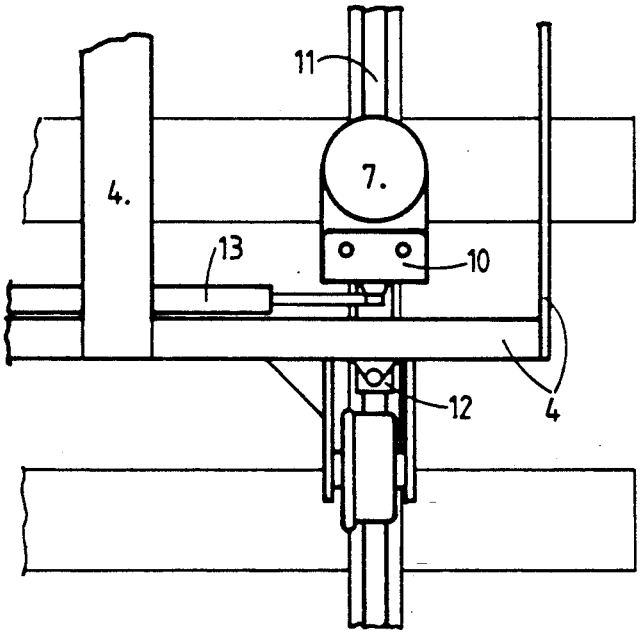

FIGS. 12 to 14 show details of the machine shown at FIG. 11 showing schematically the mounting of the grinding units.

Figure 15:
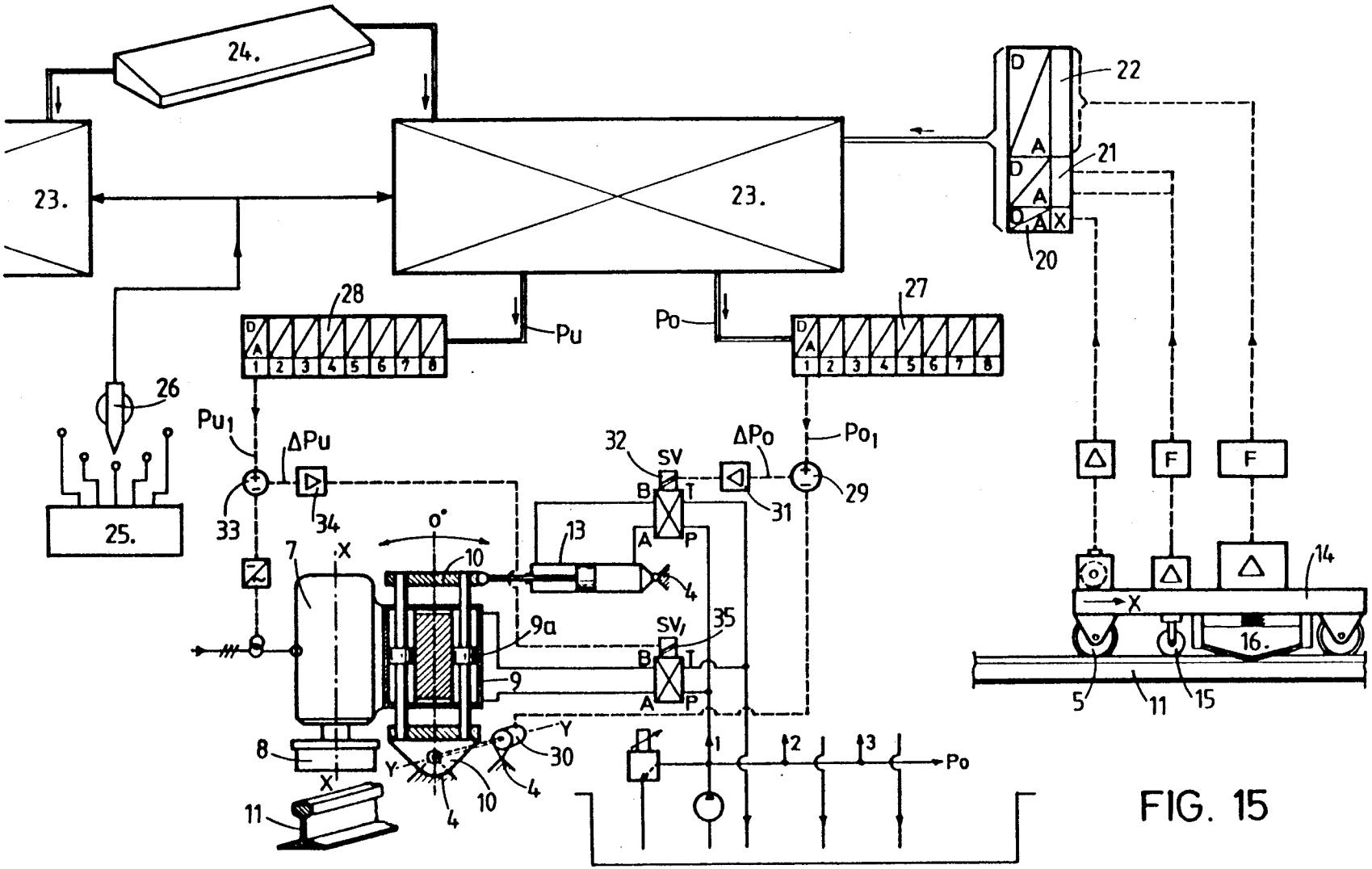
Figure 16:
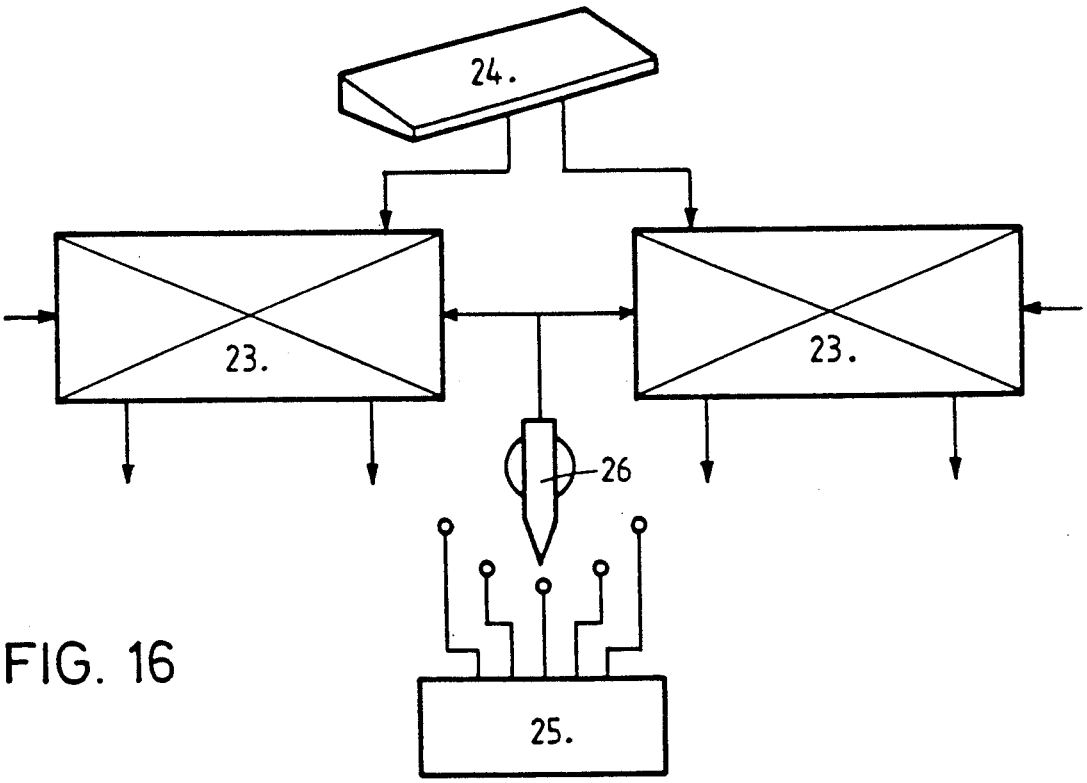

FIGS. 15, 16 show a working scheme of the reprofiling machine according to the invention.

According to the existing methods of reprofiling the rails one measures for each line of rails of a railroad track the longitudinal profile and the transversal profile of the rail, one compares these measured profiles of the two rails to only one and the same reference profile corresponding to the type of rail used, then by means of the datas obtained by these comparisons one selects and/or controls for each rail the position and the pressure of the rectification tools in order to obtain in one or several passes the desired reprofiling of each of the two rails.

Whatever the manner is to measure the rail profiles, to compare it to the reference profile and to control the reprofiling tools, all these known methods and machines developed for their performances are not capable to realize a profiling or a reprofiling which is asymetrical that is a different reprofiling simultaneously of the two rails of the track, since the comparison of the measured datas of each of the rails is always made with only one and the same reference profile determined in function of the type of rail laid and the voluntary choices concerning the desired profiling, that is if it is desired to come as close as possible to the original profile of the rail, to an average wearing off profile of the rail determined by the practice and so on. According to these methods and known machines, it is thus impossible to profile or to reprofile each rail according to its own pattern which is just what is necessary as seen above in the portions of the track having average or short curve.

To realize the aim looked for by the present invention the present method consists to compare the measured profiles of each of the rails with selected reference profiles in function of the needs, rectifications of a rectilinear portion, of a curvilinear portion of average or strong curvature, of a railroad track and the type of rail used, in order to be able thus to profile or reprofile the rails of one line differently from the rails of another line or in the same manner according to the circumstances.

According the present method one memorises at least two reference profiles, generally several profiles, then selects in function of the conditions of the track; rectilinear portions, curves having a great, average or small radius of curvature, towards the left or towards the right, a reference profile for each of the rails.

Figure 1:
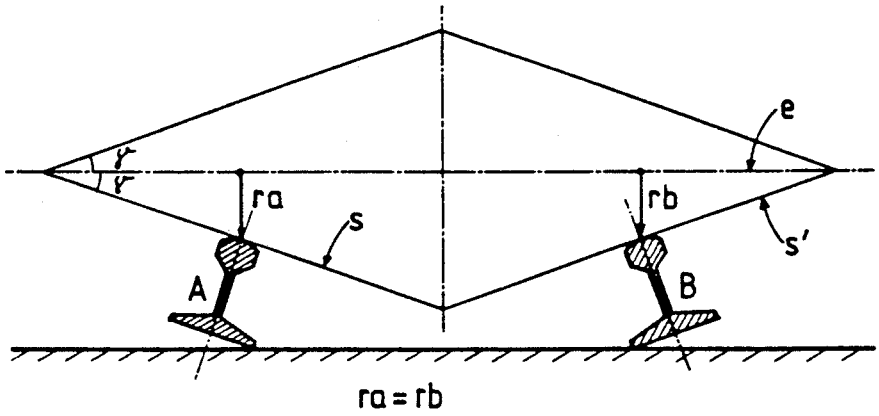
FIGS. 1 and 2 are diagrams showing the geometrical relationships of the load-bearing surfaces of the rails of a railroad track.
Figure 2:
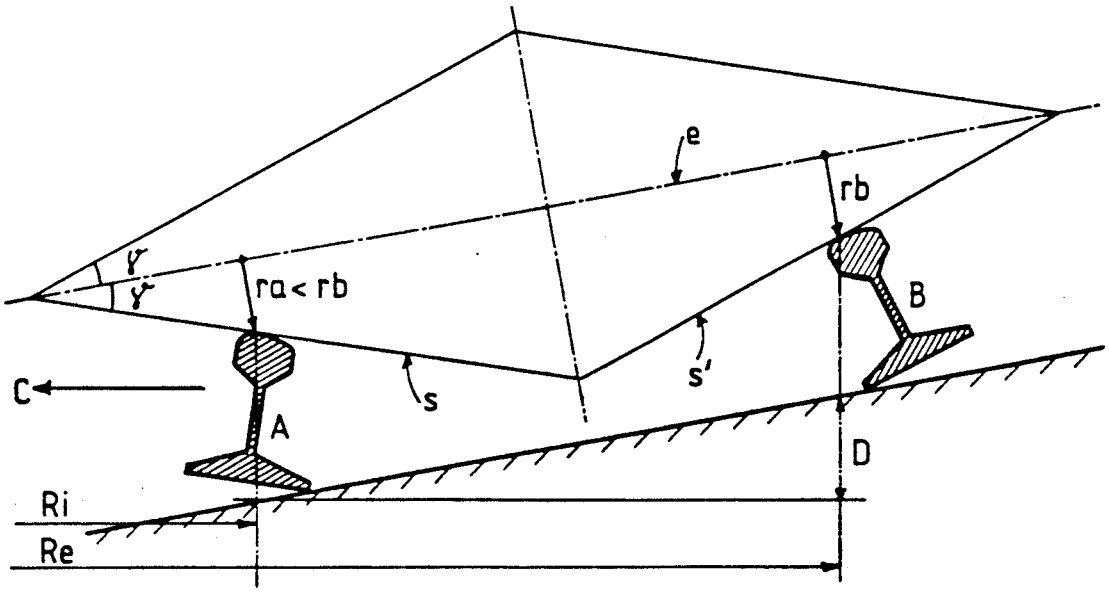
Figure 3:
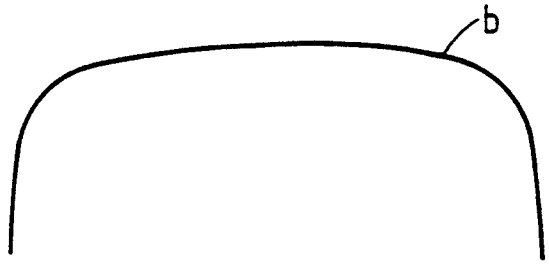
FIG. 3 shows the transversal reference profile for the rectification of the rails of a railroad track on its rectilinear portions and for a rail of a determined type.

FIG. 3 shows a reference base profile b̲ which is used for the reprofiling of one corresponding type of rails in the rectilinear portions of the track or in the portions of the track where the radius of curvature is sufficiently great so that the phenomenum of traditional autocentering can apply. On these track portions the longitudinal and transversal profiles which are measured on each rail are compared individually to the said same reference base profile, this comparison determines in a known manner the rectification parameters of each rail. These parameters defining the position, the inclination and the power of each tool with respect to the corresponding rail can be memorized for a later use or used directly for the reprofiling of the rails.

Figure 4:
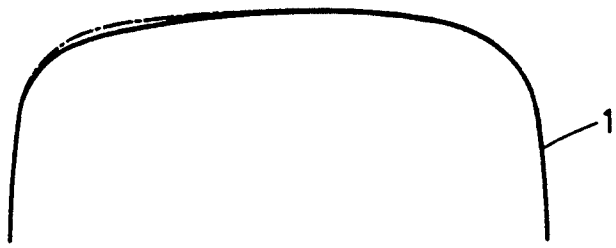
FIG. 4 shows a reference transversal profile which is asymetric for the rectification of the rails of a railroad track in curve and for a rail of a determined type.
Figure 6:
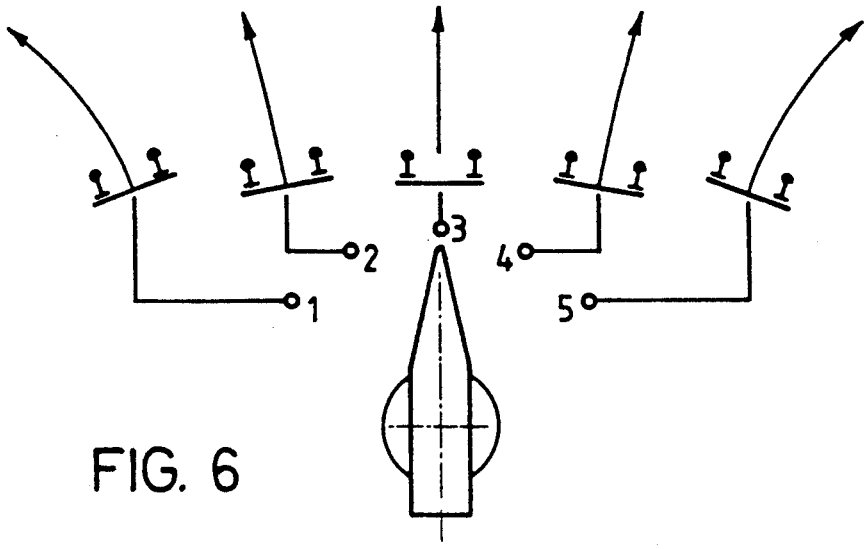
FIG. 6 shows a selection device of a pair of reference profiles.

FIG. 4 shows a reference profile which is said asymetric 1 which according to the present method is selected as reference profile:

a. for the two rails of a track when one is on a portion of track presenting a curve to the right having a strong curvature (FIG. 6, position 5).

b. for the outside rail when one is on a portion of track presenting a curvature to the right having an average radius of curvature. The inside rail would in that case be compared to a base reference profile b̲ (FIG. 3; FIG. 6, position 4).

Figure 5:
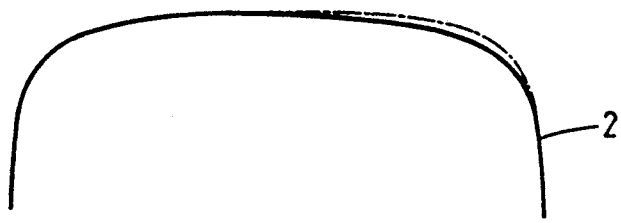
FIG. 5 shows the reference transversal profile which is asymetric for the rectification of the rails of a railroad track in a counter-curve and for a rail of a given type.

FIG. 5 shows an asymetric reference profile 2 which according to the present method is selected as reference profile:

a. for the two rails of a track when being on a portion of said track presenting a strong left curvature (FIG. 6, position 1).

b. for the outside rail when one is on a portion of track presenting an average curvature to the left; the inside rail being then compared to the base reference profile (FIG. 3; FIG. 6, position 2).

According to the present method on disposes thus at least of two, here of three reference profiles for each type of rails, reference profiles which are used as references for the one or of the two rails of a track according to the circumstances and the shape of the track.

As the asymetric reference profile 2 (FIG. 5) is the mirror image with respect to the axis of symmetry of the rail of the asymmetric reference profile 1 one can, according to the present method, store only one of said two reference asymetric profiles 1 or 2 the other one being the mirror image of it.

The present method enables thus to reprofile rails in site in an asymetric or a symetric manner as well in straight portions as in curves or counter-curves and this for all the types of rails. It is even possible to envisage to reprofile the rails of a track the lines of rails of which are formed by rails of different types.

Of course the passage from a symetrical reprofiling for a straight portions to an asymetrical reprofiling when entering curves of average or small radius of curvature has to be made rapidly that is to say it is necessary to be able to substitute practically instantaneously one reference profile to another for each of the line of rails. The same occurs when passing from a curve to a counter-curve. In order to make rapidly and easily the selection of the reference profiles to be used with each of line of rails it is obtained for example by means of a five positions switch shown at FIG. 6. The position 1 corresponds to a tight left curve and selects for the two files of rails the asymetric reference profile 2 (FIG. 5). The position 2 corresponds to a left average curve and selects for the right line of rails the asymetric reference profile 2 (FIG. 5) and for the left line of rails the base reference profile (FIG. 3).

The central position 3 of the switch corresponds to a rectilinear portion of the track and selects for the two lines of rails the base reference profile (FIG. 3).

The position 4 corresponds to an average right curve and selects for the left line of rails the asymetric reference profile 1 (FIG. 4) and for the right line of rails the base reference profile (FIG. 3). The position 5 of the switch corresponds to a tight curve to the right and selects for the two lines of rails the asymetric reference profile 1 (FIG. 4).

It is evident that this selection of the reference profile or of the appropriated reference profiles for the reprofiling of a given portion of a track can be made in any other manner, for example by means of a numerical or alphanumerical keyboard or even automatically for example in function of the distance traveled by the machine and/or by the measure of the curvature of the track.

According to the present method it is evident that at each modification of a reference profile relative to one line of rails must correspond a modification of the pattern or of the configuration of the tools of the corresponding line of rails, that is to say of the position, the inclination and the power or resting force of these tools onto the rail, so that this new configuration of the tools is the one which corresponds at the best to the obtention of the new design profile counted from the real measured profile of the rail.

With the present method it is possible to think that the selection of a new reference profile for one line of rails causes automatically the adequate modification of the configuration of the tools affected to said line of rails and this instantaneously and simultaneously for all the tools.

This however can present a drawback particularly for reprofiling machines comprising an important number of tools for each line of rails. In fact in this case, the tools working on a same line of rails being disposed along the machine on a distance which can be from 5 to 20 meters for example it is not possible to determine with precision at which location the modification of the configuration of the tools has to be done.

To avoid this inconvenient, the tools can be individually controlled with a different delay depending from the elapsed path of the vehicle so that the modification of the configuration be realized for each tool, individually, at a same point T of the track corresponding to the transition point between the rectilinear portion and the curve for example. Thus each tool will take its new position in said same point T of the track.

In brief, according to the method according to this invention, for the programmation and/or the profiling or reprofiling of rails of a railroad track:

one creates two independant channels of information treatment, measure and comparison and of selection and/or control of the configuration of the tools, each of these channels being assigned to one of the lines of rails of the railway track.

One has at least two different reference profiles, generally one or several asymetric profiles for each base reference profile.

One selects in function of the shape of the track and/or of the type of rails used for each line the reference profile assigned to each of the lines of rails. These reference profiles can be identical or different.

In the case of the profiling, each pair of selected reference profiles corresponds to configuration of reprofiling tools which are adequate for each of the two lines of rails. The change of configuration is made simultaneously for all the tools or successively in function of the travelling of the vehicle, so that this change happens for each tool at a same given point T of the track.

The machine or railroad vehicle for the automatical profiling of rails of a railroad track can be in a general way similar to the one described in the patents mentioned in the introduction but to the fact that it comprises channels for measuring the rail profiles, comprising these ones with a reference profile and selectioning and/or controlling the adequate configuration of the tools in position, inclination and power, which are independant for each line of rails. It comprises further selecting means in function of the shape of the track of a pair of reference profiles among a plurality of reference profiles, one of the reference profiles being assignated to one of the channels and thus to one of the line of rails where as the other reference profile is assignated to the other line of rails.

The introduction or the storing of a reference profile can be made in numerous different ways, however for the base reference profile a secure manner to define it consists to set under the measuring apparatus a test rail and to adjust the zeros of the differents feelers.

The asymetric profiles being very near to the base reference profile, a modification of the test rail could cause errors. It is therefore preferable to introduce in the form of a table, the differences from one profile to the other.

One creates thus in Cartesian coordinates or in polar coordinates a table defining the asymetric profile as having for each side line of the base profile a difference $\Delta$ determinated with respect to it.

It is therefore possible to create by calculation the asymetric profile or the asymetric profiles from the base reference profile avoiding any error due to the manipulation of the measuring apparatus or of the test rail.

FIG. 7 shows the representation in full line of a base reference profile b, in dashed line a first symetric reference profile 1 and in dotted lines a second asymetric reference profile 1a the asymetry of which is greater. The two reference profiles 1 and 1a are provided for the reprofiling of curves to the right, their mirror images serving to the reprofiling of curves to the left.

FIG. 7*a* gives under the shape of a table the Cartesian coordinates of the base reference profile and of the two asymetric reference profiles. These are the tables which are stored and used to receive the reference profiles without manipulation errors. Such a table gives for example as shown in coordinates Xi; Yi of the reference base profile for different points of it as well as the differences Δy1; Δy1a between the base profile b and the asymetric reference profiles 1 and 1a .

One sees that one can have several asymetric reference profile for the left or for the right usable according to the wearing off degree of a rail or the curvature degree of a curve.

A variant of the method, a detailed example of which is shown at FIGS. 7 to 10, is particularly adapted for the reprofiling of rails in the transition curves between a straight portion and the minimum radius R min of the full curve. It is necessary in that case to go progressively or through successive steps for the reference profiles of the two lines of rails from the base reference profile for the straight portions to the asymetric profile intended for the full curve.

This can be obtained by dividing the transition curve in portions named $1_1$, $1_2$, $1_3$, $1_4$ (FIG. 8) and in having correspond to each of these portions a pair of reference profiles, that is one reference profile for each rail, intermediate between the base profile of the rectilinear profile and the asymetric profile of the full curve.

It can be the same when passing by means of two transition curves from a curve having a radius R1 to a counter-curve having a radius R2 where one passes for example from a pair of left asymetric profiles to a pair of right asymetric profiles in passing through the base profile at the inflexion point.

As shown in FIG. 10 the passage from the full curve of radius R1 to the full curve of radius R2 is made by the intermediary of two transition curves L1 and L2 which are divided in seven portions $1_1$ to $1_7$. For the portions $1_1$, $1_2$, $1_3$, the pairs of reference profiles are degressively asymetric. For $1_4$ the pair of reference profiles is the one used for straight portion that is the base reference profile. For the portions $1_5$, $1_6$, $1_7$ the pairs are progressively asymetric but in opposite direction as to the preceedent. It is practically impossible to make a precise asymetric reprofiling of the rails of such a railroad section with conventional machines. The preselection of the pairs of reference profiles is made advantageously by means of a device according to FIG. 9 comprising a switch for the left or right directions of the curve and a preselection decade for the recalling of the memorized pairs of reference profiles.

FIG. 11 shows seen from the side a machine for the rectification of the rails of a railroad track constituted by an automotor vehicle 3 provided with grinding carriages 4. These grinding carriages 4 are provided with rollers having flanges resting in working position onto the rails of the track and are connected to the vehicle 3 on the one hand by a traction rod 5 and on the other hand through lifting jacks 6. These jacks permit a lifting of the carriage for the high speed running of the vehicle for displacing it from one workplace to the other.

Each grinding carriage 4 carries several grinding units for each line of rails, each of these grinding units comprises a motor which drives a grinding wheel 8 in rotation.

As particularly well seen at FIG. 13 each grinding unit 7,8 is displaceable along its longitudinal axis X—X with respect to the carriage 4. In fact the motor 7 carries the chamber 9 of a double effect jack the piston 9*a* of which is fastened with the rod crossing the chamber 9, fastened with a support 10. This support 10 is hinged on the carriage 4 around an axis Y—Y parallel to the longitudinal axis of the rail 11. The angular position of the grinding units is determined by an angle detector 12 fastened with the support 10 and controlled by a double acting jack 13 connecting this support 10 to the carriage 4.

In this way, each grinding unit is angularly displaceable around an axis parallel to the longitudinal axis of the rail to which it is associated and perpendicularly to this longitudinal axis which enables to displace the grinding wheel 8 towards the rails 11 and to apply it against it with a determined force so as to move it out from engagement of said rail.

The vehicle 3 is further equipped with measuring carriages 14 rolling along each rail equipped with a measuring device 15 of the longitudinal undulations of the surface of the rail 11 and with a measuring device of the transversal profile 16 of the head of the rail. The carriages 14 are of course driven by the vehicle 3 for example through a rod 17.

The machine described (FIG. 15) comprises further a treatment device for the datas delivered by the feeler 5 of the elapsed distance, the feeler 15 of the amplitude of the longitudinal undulations of the rail and the detector 16 of the transversal profile of the rail and for the control of the reprofiling unit 7,8 as well in position as in power to reprofile the rail 11 so as to give him again a longitudinal profile as well as a transversal profile identical to or near to the reference profile which is assigned to it.

This device for the treatment of the measuring signals and the control signals of the reprofiling units is very schematically illustred at FIGS. 15 and 16. It comprises for each line of rails three analogue-digital converters 20,21,22 respectively associated to the detectors 5, 15 and 16 and transforming the analogic measuring signals delivered by these detectors in digital signals with are delivered to a micro-processor 23.

This micro-processor 23 receives further information which are either introduced manually through an alphanumeric keyboard 24 relative for example to the type of machine used, to the number of grinding units for each line of rails which it comprises, and to the capacity of metal removing of the grinding stones used in function of the power of the motors driving these grinding wheels.

This treatment device comprises further a memory 25 of the pairs of available reference profiles, that is a base reference profile for the grinding of the rectilinear portions and several asymetric reference profiles for the grinding of the curves and counter-curves or transition curves. A manual or automatic selector 26 permits in function of the portion of track to be reprofiled to deliver at each of the micro-processors 23 one of the reference profiles of a selected pair and to assign it to a determined rail.

The micro-processors 23 associated each to a line of rails determine in function of the datas which have been furnished to them and which have been enumerated hereabove for each reprofiling unit working on the corresponding line of rails a digital control signal of the position Po and a control signal of the power Pu.

Digital analogic converters 27,28 convert these digital control signals Pu and Po in analogic control signals for each of the reprofiling units 7,8. FIG. 15 shows the feedback loop of a reprofiling unit, the unit No 1 of the right rail 11 of the track.

The analogic signal of the position $PO_1$ is compared in a comparator 29 to the output signal of an angle detecior 30 indicating the angular position of the support 10 and thus of the grinding unit with respect to the axis Y—Y parallely to the longitudinal axis of the rail. If there is no equality between the signal $PO_1$ and the one delivered by the angle detector 30 the comparator delivers a correction signal of the position ΔpO, positive or negative, controlling, through the intermediary of an amplifier 31, a servo-valve 32 controlling the double effect jack 13 ensuring the angular positioning of the grinding unit 7,8.

The power analogic signal Pu1 is compared by means of a comparator 33 to a signal proportional to the instantaneous power of the motor 7 and, in case of inequality of the signals, the comparator 33 delivers a correction signal for the power ΔPu, controlling through the intermediairy of an amplifier 34 a servo-valve 35 to control the double-acting jack **9,9*a* modifying the pressure applying the grinding wheel 8 against the rail 11**.

Thus, the described machine to perform the asymetric reprofiling method comprises for each line of rails a channel comprising at least measuring means of the transversal profile of the rail but generally also the elapsed distance and the longitudinal profile of the rail, undulations of great or small waves length; comparison means of this profile to a reference profile assigned to said rail; as well as control and/or selecting means in function of the datas of said comparison of a configuration in position and power of each tool or reprofiling unit associated to said rail. The comparison means of the measured profiles and reference profiles as well as the selection means of the configuration, position and power, of the tools are in the example shown grouped in the microprocessor 23.

Finally this reprofiling machine comprises means 25 to memorize at least one reference base profile and at least one other reference profile, generally several asymetric reference profiles for each base profile; as well as selecting means 26 of a pair of reference profiles and assignating to each of the lines of rails one of the said profiles of this pair.

In the case of a machine such as the one described, the measure of the short and long longitudinal waves of each rail can enable the micro-processor 23 to determine the reprofiling modes, soft or aggressive, according to the amplitude of the undulations, and free or blocked, according to the wavelength of said undulations. In aggressive mode an over-power is added to the motors. In free mode each grinding unit is independent for the grinding of the short waves whereas in blocked mode several grinding units are fast the one with the other so as to increase the length of the reference base for the reprofiling of the long waves.

The machine according to the invention comprises always two measuring channels, one for each line of rails, as well as two control channels, one for each line of rails.

However it could comprise in a variant only one microprocessor working sequentially, alternatively with the one and the other measuring and controlling channels.

As the machine works in the two directions it is equipped with two measuring carriages 14. The front carriage being used for the control of the reprofiling operation and the rear carriage being used for checking this operation.

We claim:

1. A profiling or reprofiling method of the rails of a railroad track comprising the steps of measuring for each line of rails at least its transversal real profile; establishing for at least one type of rails one transversal base reference profile and at least another transversal reference profile; selecting one pair of reference profiles; attributing to each of the lines of rails one of the reference profiles of the pair selected; comparating the real transversal profile of each line of rails with the reference transversal profile which is assigned to it, and selecting a particular tool configuration for each line of rails in function of said comparison datas.

2. A method according to claim 1, comprising further the control by means of the comparison datas of a particular tool configuration for each line of rails and making a continuous in site reprofiling.

3. A method according to claim 1, comprising the steps of establishing for each reference base profile at least two asymetric reference profiles which are mirror opposed the one from the other.

4. A method according to claim 1, in which for the reprofiling of a portion of track in alignment, that is approximatively rectilinear, or forming a curve having a great radius of curvature, one assigns to each line of rails the base reference profile.

5. A method according to claim 1, in which for the reprofiling of a portion of track presenting a curve having a medium radius of curvature one assigns to the inside rail a base reference profile and to the outside rail an asymetric reference profile corresponding to the direction left or right of the curve.

6. A method according to claim 1, in which for the reprofiling of a portion of track presenting a narrow curve one assigns to the two lines of rails an asymetric reference profile corresponding to the direction left or right of the curve.

7. A method according to claim 1, in which the change of tool configuration is controlled simultaneously for all the tools.

8. A method according to claim 1, in which the change of configuration of each tool is controlled separately in function of the advancement of the machine so that said modification of configuration is effected for all the tools at a same point of the track.

9. A method according to claim 1, in which a base reference profile is established by means of a test rail; the asymetric reference profile or the asymetric reference profiles being established by taking in consideration differences which are pre-established between a number of determined points of the base profile and of the asymetric profiles.

10. A machine for the reprofiling of rails of a railroad track comprising measuring means of the transversal profile of the rail for each line of rails; storing means of at least one base reference profile for each type of rails and of at least one other reference profile for each base reference profile; selecting means of a pair of reference profiles as well as means for assigning one of these reference profiles of the pair to one of the line of rails and the other profile to the other line of rails; comparison means of the measured profile of each rail to the selected reference profile; means for selecting as a function of these comparison data on the configuration, position and power, of reprofiling tools assigned to each of the line of rails.

11. A machine according to claim 10, comprising further control means to control the selection means of a pair of reference profiles in function of the shape or lay out of the track.

12. A machine according to claim 10, in which the control means of the configuration of the tools relative to each of the line of rails cause a simultaneous modification of the configuration of all the tools.

13. A machine according to claim 10, in which the control means of the configuration of the tools cause a sequential modification of the tools relative to each line of rails in function of the advancement of the machine along the track.

* * * * *